US005549304A

United States Patent [19]

Davis

[11] Patent Number: 5,549,304

[45] Date of Patent: Aug. 27, 1996

[54] RECREATIONAL PRACTICE APPARATUS FOR SOCCER PLAYERS

[76] Inventor: Jimmy D. Davis, 401 Maxine Dr., Choctaw, Okla. 73020

[21] Appl. No.: 509,889

[22] Filed: Aug. 1, 1995

[51] Int. Cl.[6] ..... A63B 63/00; A63B 69/00

[52] U.S. Cl. ..... 273/396; 273/400

[58] Field of Search ..... 273/394, 395, 273/396, 398, 400, 402

[56] References Cited

U.S. PATENT DOCUMENTS 2,944,816 7/1960 Dixon ..... 273/26 A 3,427,026 2/1969 Mahoney ..... 273/1.5

4,650,189 3/1987 Rajacich ..... 273/26 A 5,431,411 7/1995 Padilla ..... 273/400

*Primary Examiner*—William H. Grieb

*Attorney, Agent, or Firm*—Robert K. Rhea

[57] ABSTRACT

A soccer player's ball control apparatus is formed by a ball rebounding net tautly supported within a rectangular frame joined in right angular relation with a soccer goal frame and goal net. When the soccer goal frame is disposed on the surface of the earth, the ball rebound net and frame is disposed upright for rebounding balls kicked or thrown there against. When the rebounding net is flatly disposed on the surface of the earth, the soccer goal and net is in an upright position for receiving balls kicked through the goal frame.

1 Claim, 1 Drawing Sheet

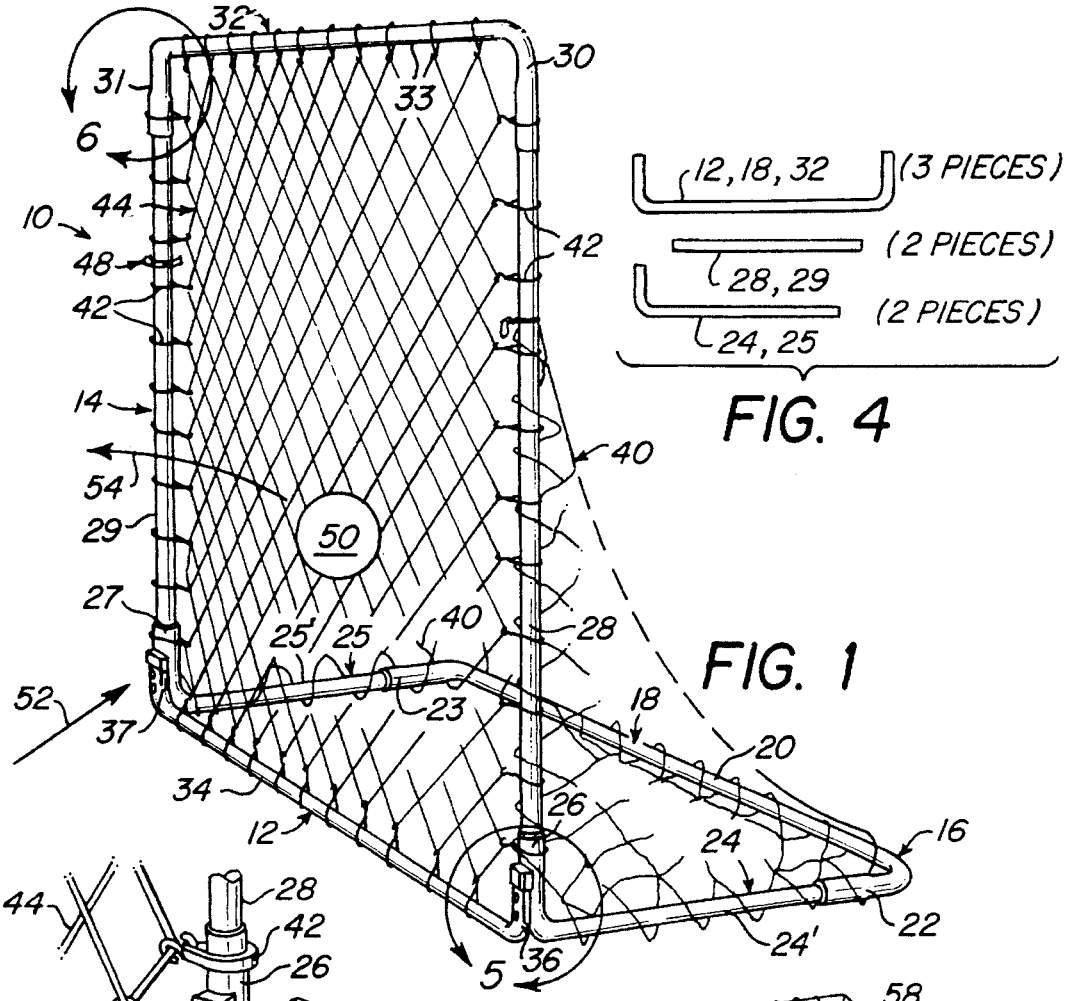
FIG. 4
FIG. 1
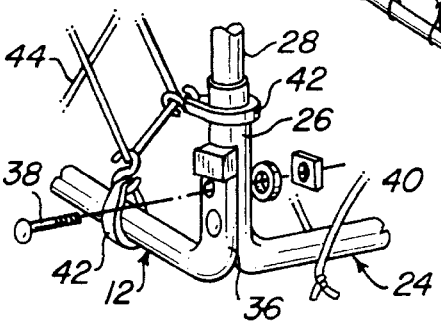
FIG. 5
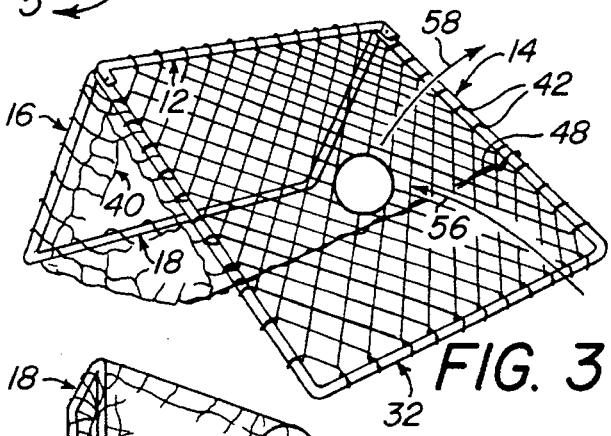
FIG. 3
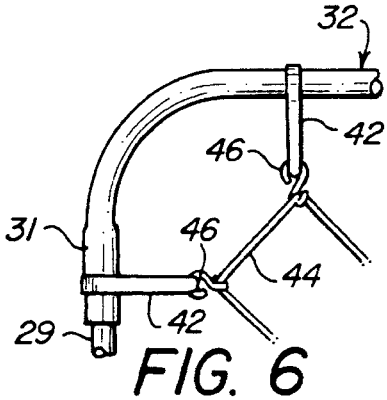
FIG. 6
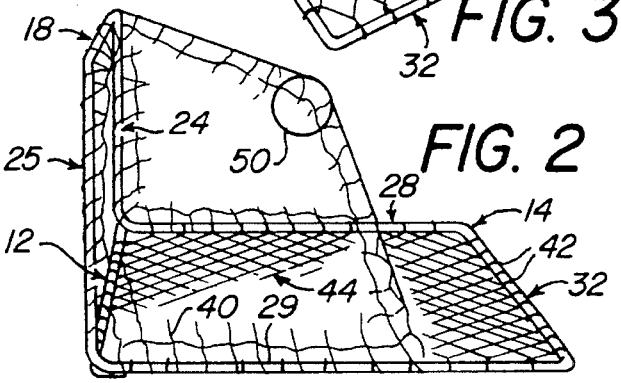
FIG. 2

RECREATIONAL PRACTICE APPARATUS FOR SOCCER PLAYERS

BACKGROUND OF THE INVENTION

1. Field of the Invention

This invention relates to a recreational apparatus for rebounding or containing balls thrown or kicked at it and more particularly this invention relates to an apparatus for training soccer players.

2. Description of the Prior Art

Numerous types of ball rebounding apparatus are found in the prior art and for the most part comprise various frame and net configurations usually disposed generally upright with a frame supporting a net on an incline with respect to the horizontal.

The most pertinent patent is believed U.S. Pat. No. 4,650,189 issued Mar. 17, 1987 to Rajacich for RECREATIONAL PRACTICE APPARATUS FOR REBOUNDING BALLS. This patent discloses a three frame net disposed at obtuse angles around a common axis disposing one frame vertically and the other two on upward converging angles against which two players may simultaneously throw balls at the upright or the inclined net.

U.S. Pat. No. 2,944,816 issued Jul. 12, 1960 to Dixon for RECREATIONAL APPARATUS and U.S. Pat. No. 3,427,026 issued Feb. 11, 1969 to Mahoney for PROJECTILE RETURN APPARATUS are believed to generally show the further state-of-the-art. Each of these patents disclose a frame supporting a net on a selected incline supported on a base with the angle of incline being adjustable relative to the base for rebounding balls thrown against the net.

SUMMARY OF THE INVENTION

An elongated rigid frame is transversely turned at right angle intermediate its ends to form a pair of frames sharing a cross member as one end limit of each of the frames. One of the frames has equal length side and end members forming a square configuration which supports a net in the plane of the frame. The other frame end members are shorter than its side members to define a rectangular frame substantially equal with the dimensions of a soccer goal frame.

The end member of the last named frame, opposite the square frame, and its side members support a portion of the perimeter of a net having its remaining perimeter portions secured to the adjacent sides and intermediate the length of the square frame net to loosely form a soccer goal.

The goal frame supports the square frame in a vertical plane and conversely the square frame supports the soccer goal forming frame in a vertical plane. Alternatively, when the remote ends of the frames are disposed on a common horizontal surface, the net of the square frame is disposed on a fixed upwardly inclined angle for rebounding balls in an upward direction.

The principal objects of this invention are to provide: net supporting frames which presents a vertical ball rebounding face when the frames are in one position; form a soccer goal when frames are in a second position; and, form an inclined plane ball rebounding face when the frames are disposed in a third position for training and improving the proficiency of a soccer player.

BRIEF DESCRIPTION OF THE DRAWINGS

FIG. 1 is a perspective view of the apparatus in one position illustrating a ball rebounding from an upright net;

FIG. 2 is a perspective view to a smaller scale illustrating the apparatus in soccer goal position;

FIG. 3 is a perspective view of the apparatus in a third position for rebounding soccer balls from an inclined net;

FIG. 4 illustrates the principal frame components;

FIG. 5 is a fragmentary perspective view of the area enclosed by the arrow 5; and, FIG. 6 is a fragmentary perspective view of the area enclosed by the arrow 6.

DESCRIPTION OF THE PREFERRED EMBODIMENTS

Like characters of reference designate like parts in those figures of the drawings in which they occur.

The reference numeral 10 indicates an elongated rectangular frame bent at right angles intermediate its ends about the axis of a transverse cross member 12 to form a larger frame 14 and a smaller frame 16 each having the cross member 12 as one end limit thereof. Both of the frames 14 and 16 are formed from tubular material of selected rigidity in accordance with a desired rigidity of the respective frames. The frame 16 forms the perimeter of a soccer goal when the frames 10 are disposed in the position of FIG. 2 as presently explained.

The frame 16 is formed by a U-shaped member 18 having a bight portion 20 substantially equal in length with the width of a conventional soccer game goal. Legs 22 and 23, relatively short when compared length of the bight portion 20, extend in orthogonal parallel relation from one side of the U-shaped member 18.

The frame 16 further includes L-shaped side members 24 and 25 each having a leg portion, 24' and 25', respectively, telescopically received by the U-shaped member legs 22 and 23 respectively. The combined length of the L-shaped member legs 24 and 25 when combined with the length of the respective U-shaped member 18 legs 22 and 23 is substantially equal to the vertical dimension of a soccer game goal frame opening for the reasons presently explained. The L-shaped member foot portions 26 and 27 extend orthogonally upward in parallel relation from the respective L-shaped leg 24' and 25' and telescopically receive the depending end portion of a pair of straight members 28 and 29 each forming a portion of the respective side of the frame 14.

The upper end portions of the side members 28 and 29 are respectively telescopically inserted into the leg portions 30 and 31 of a U-shaped member 32, substantially identical with respect to the U-shaped member 18, similarly having a bight portion 33.

The cross member 12 is similarly U-shaped having a bight portion 34 substantially equal in length with respect to the bight portions 20 and 33 of the U-shaped members 18 and 32. Each of the cross member 12 legs 36 and 37 are flattened and contiguously contact the surface of the L-shaped member foot portions 26 and 27 opposite the U-shaped member 18, and are cooperatively line drilled with each of the foot portions 26 and 27 for receiving bolts and nuts 38 (FIG. 5) securing the cross member 12 to the foot portions of the L-shaped members for forming an end member 12 common to both frames 14 and 16.

Prior to assembly of the soccer frame 16 components, the perimeter portion of one end and adjacent sides of a soccer goal net 40 are threaded on the bight portion 20 of the U-shaped member 18. Prior to joining the U-shaped cross member 12 to the L-shaped member foot portions 26 and 27, the side portions of the soccer net 40 are pulled from the U-shaped member bight portion 20 to extend along the L-shaped members 24 and 25 and substantially two-thirds of the length of the frame 14 side members 28 and 29 for the purposes which will presently be apparent. Also, prior to assembly of the frame 14 componets, a plurality, forty-four (44) in the example shown, of rubber bands 42 of selected width and diameter are placed on the frame 14 respective end and side members which when equally spaced there-around results in eleven (11) of the rubber bands on each of the frame 14 respective sides and ends for resiliently supporting a rebound or kick-back net 44 having perimeter dimensions slightly smaller than the inside dimensions of the frame 14. The strands of the net 44 are connected with the frame 14 end member and side members by a like plurality of S-shaped hooks 46, more clearly illustrated by FIG. 6. The kick-back net 44 is most easily connected with the frame 14 by connecting the respective corner portions of the net to adjacent S-hooks and rubber bands at the four corners of the frame, and thereafter connecting every other S-hook and rubber band with the frame around the inside perimeter of the frame 14, and thereafter connecting the skipped S-hooks and rubber bands to the net.

The soccer goal net 40 opposite the end surrounding the bight portion of the U-shaped member 18 is manually drawn upwardly to substantially the position illustrated by FIG. 1 to stretch the net 40 tight and transversely connect it to the frame 14 side members and the net 44 as by a cord 48 weaving the two nets together at this position.

OPERATION

Assuming the frame components and nets have been assembled as described hereinabove and with the device disposed in the position of FIG. 1, a ball 50 thrown or kicked toward the net, in the direction of the arrow 52, is rebounded therefrom substantially in the direction of the arrow 54. When the frames 10 are disposed upon their back such as illustrated by FIG. 3, a ball thrown toward the net 44, in the direction of the arrow 56, is rebounded from the net 44 substantially in the direction of the arrow 58. When the frame 14 is flatly disposed upon the surface of the earth and the soccer goal frame 16 is disposed in an upright position as illustrated by FIG. 2, the device forms a soccer goal in which a ball 50 kicked toward the opening of the soccer frame 16 is contained by the net 40, as illustrated by FIG. 2.

Obviously the invention is susceptible to changes or alterations without defeating its praticability. Therefore, I do not wish to be confined to the preferred embodiment shown in the drawings and described herein.

I claim:

1. A soccer player ball control practice apparatus, comprising:

a pair of rectangular orthogonally joined frames; a net supported by each frame of said pair of frames for forming an upright ball rebounding surface when said pair of frames are in a first position and for forming a soccer goal when said pair of frames are in a second position, said pair of frames form an inclined ball rebounding surface when said pair of frames are in a third position;

an end member joined at its respective end portions with one end portion of a pair of side members; and, a third end member, common to both frames of said pair of frames, extending transversely between one said pair of side members at the juncture of the end portions of said pairs of side members opposite said one end portion.

* * * * *